US008944839B2

(12) United States Patent
Pfeiffer

(10) Patent No.: US 8,944,839 B2
(45) Date of Patent: Feb. 3, 2015

(54) METHOD FOR CONNECTING PLUG PARTS OF AN ELECTRICAL PLUG-IN CONNECTOR, AND ELECTRICAL PLUG-IN CONNECTOR

(75) Inventor: Wolfgang Pfeiffer, Kuenzelsau (DE)

(73) Assignee: Intercontec Pfeiffer GmbH, Niederwinkling (DE)

( * ) Notice: Subject to any disclaimer, the term of this patent is extended or adjusted under 35 U.S.C. 154(b) by 42 days.

(21) Appl. No.: 13/878,939

(22) PCT Filed: Oct. 11, 2011

(86) PCT No.: PCT/EP2011/067715
§ 371 (c)(1),
(2), (4) Date: Apr. 16, 2013

(87) PCT Pub. No.: WO2012/049168
PCT Pub. Date: Apr. 19, 2012

(65) Prior Publication Data

US 2013/0196554 A1 Aug. 1, 2013

(30) Foreign Application Priority Data

Oct. 12, 2010 (DE) ..... 10 2010 042 345

(51) Int. Cl.
*H01R 13/62* (2006.01)
*H01R 43/00* (2006.01)
(Continued)

(52) U.S. Cl.
CPC ..... *H01R 13/506* (2013.01); *H01R 13/642* (2013.01); *H01R 43/00* (2013.01);
(Continued)

(58) Field of Classification Search
USPC ..... 439/350–358
See application file for complete search history.

(56) References Cited

U.S. PATENT DOCUMENTS 3,680,033 A 7/1972 Kawai
4,017,139 A * 4/1977 Nelson ..... 439/352
(Continued)

FOREIGN PATENT DOCUMENTS

DE 33 37 686 C1 2/1985
EP 0 135 299 A2 3/1985
EP 0 141 958 A1 5/1985

OTHER PUBLICATIONS

International Search Report, International Patent Application No. PCT/EP2011/067715, date of completion Dec. 22, 2011, 3 pages.
(Continued)

*Primary Examiner* — Gary Paumen
(74) *Attorney, Agent, or Firm* — Fitch, Even, Tabin & Flannery, LLP

(57) ABSTRACT

The present application relates to a method for connecting plug parts of an electrical plug-in connector, in which on a first plug part a hollow cylindrical retaining sleeve is disposed movably in axial direction relative to the first plug part, wherein the retaining sleeve is retained in a first position biased by a bias spring and the axial relative movement is effected against the spring force, and upon connecting the plug parts, a spring element disposed on the second plug part is pressed radially outwards in a connecting intermediate state, upon further axially pushing together the plug parts, the retaining sleeve is displaced axially backwards from the first position by the spring element, and upon further pushing together the plug parts, the spring element snaps radially inwards into a recess and the backward displacement of the retaining sleeve by the spring element is terminated and the retaining sleeve is automatically again brought into the first position by the bias spring, wherein the spring element is introduced into a first clearance between an outer side of the first plug part and an inner side of the retaining sleeve before contacting the retaining sleeve for the axial displacement thereof effected by the spring element. The present application also relates to an electrical plug-in connector.

13 Claims, 8 Drawing Sheets

(51) Int. Cl.

| | |
|---|---|
| ***H01R 43/26*** | (2006.01) |
| ***H01R 13/627*** | (2006.01) |
| ***H01R 13/506*** | (2006.01) |
| *H01R 13/642* | (2006.01) |
| *H01R 13/639* | (2006.01) |

(52) U.S. Cl.

CPC ..... *H01R 43/26* (2013.01); *H01R 13/639* (2013.01); *H01R 13/6275* (2013.01)

USPC ..... 439/352

(56) References Cited

U.S. PATENT DOCUMENTS

| | | | | | |
|---|---|---|---|---|---|
| 4,362,348 | A * | 12/1982 | Stephenson et al. | ..... | 439/258 |
| 4,545,633 | A * | 10/1985 | McGeary | ..... | 439/141 |
| 4,820,204 | A | 4/1989 | Batty | | |
| 4,927,374 | A | 5/1990 | Batty | | |
| 5,176,533 | A | 1/1993 | Sakurai et al. | | |
| 5,997,333 | A * | 12/1999 | Konda et al. | ..... | 439/352 |
| 7,108,540 | B2 * | 9/2006 | Annecke | ..... | 439/352 |
| 7,201,608 | B2 * | 4/2007 | Rosenberger et al. | ..... | 439/578 |
| 7,513,788 | B2 * | 4/2009 | Camelio | ..... | 439/352 |
| 2002/0019161 | A1 * | 2/2002 | Finke et al. | ..... | 439/352 |
| 2004/0106320 | A1 | 6/2004 | Collin et al. | | |
| 2010/0093205 | A1 * | 4/2010 | Stone et al. | ..... | 439/352 |

OTHER PUBLICATIONS

English Translation of International Preliminary Report on Patentability, International Patent Application No. PCT/EP2011/067715, dated Apr. 12, 2013, 8 pages.

* cited by examiner

METHOD FOR CONNECTING PLUG PARTS OF AN ELECTRICAL PLUG-IN CONNECTOR, AND ELECTRICAL PLUG-IN CONNECTOR

CROSS-REFERENCE TO RELATED APPLICATIONS

This application is a U.S. national phase application filed under 35 U.S.C. §371 of International Application PCT/EP2011/067715, filed on Oct. 11, 2011, designating the United States, which claims priority from DE 10 2010 042 345.9, filed on Oct. 12, 2010, which are hereby incorporated herein by reference in their entirety.

FIELD

The present application relates to a method for connecting plug parts of an electrical plug-in connector, in which on a first plug part, a hollow cylindrical retaining sleeve is disposed movably in axial direction relative to the first plug part. The retaining sleeve is biased by a bias spring and retained in a first position, wherein the axial relative movement is effected against the spring force. Upon connecting the plug parts, a spring element disposed on the second plug part is pressed radially outwards in a connecting intermediate state, upon further axially pushing together the plug parts, the retaining sleeve is displaced axially backwards from the first position by the spring element, and upon further pushing together the plug parts, the spring element is snapped radially inwards into a recess and the backward displacement of the retaining sleeve effected by the spring element is terminated. Then, the retaining sleeve is automatically again brought into the first position by the bias spring and correspondingly pushed forwards. Furthermore, the present application relates to an electrical plug-in connector with two plug parts. A method as well as a corresponding plug-in connector, as they were mentioned above, is known from U.S. Pat. No. 5,176,533.

BACKGROUND

A substantial disadvantage of these known plug-in connectors and the mode of connection thereof is to be seen in that the spring element impacts on a front rim of the retaining sleeve and then attempts to push it backwards. On the one hand, thereby, the front rim of the retaining sleeve is worn and optionally also bent outwards and damaged. On the other hand, undesired radial forces occur on the retaining sleeve by this front-side impact by the outwardly bent spring elements upon pushing back the retaining sleeve. Moreover, the returning or pushing back of the retaining sleeve by the spring element impacted on the front side also is only partly suitable and precise. Outward slipping off of the spring element on the front end of the retaining sleeve also cannot be excluded such that the spring element can also be bent and damaged. Moreover, the front end of the spring element is solidly and thus inflexibly formed.

From U.S. 2004/0106320 A1, a plug in connector is known, in which two plug parts can be connected to each other. A retaining sleeve is disposed in axially displaceable manner by a spring on a first plug part. On the second plug part, a spring element is disposed, which displaces the retaining sleeve backwards upon connecting the plug parts and snaps into a recess after reaching a specific displacement distance, such that the retaining sleeve is again automatically pressed forwards.

Moreover, from DE 33 37 686 C1, there is also known a plug in connector with two connectable plug parts, wherein a retaining sleeve is retained on a plug part biased via springs.

SUMMARY

It is the object of the present application to provide a method for connecting plug parts of an electrical plug-in connector as well as such an electrical plug-in connector, in which a lower-wear connection and more secure movement guidance of the components is ensured.

This object is solved by a method having the features according to claim 1 and a plug-in connector having the features according to claim 11.

In a method according to the present application for connecting plug parts of an electrical plug-in connector, on a first plug part, a hollow-cylindrical retaining sleeve is disposed movably in axial direction relative to the first plug part. In particular, thus, a so-called push-pull plug is realized. In particular, the retaining sleeve is exclusively only displaceable in axial direction in its functionality for securing and releasing connecting states.

The retaining sleeve is retained in a first position biased by a bias spring of the plug-in connector. The axial relative movement of the retaining sleeve to the first plug part is effected against the spring force. Upon connecting the plug parts, a spring element disposed on the second plug part is pressed radially outwards into a connecting intermediate state. Upon subsequent further axially pushing together the plug parts, the retaining sleeve is displaced axially backwards from the first position by the spring element, and upon further pushing together the plug parts, this spring element is snapped radially inwards into a recess. In particular, the backward displacement of the retaining sleeve by the spring element is then terminated and the retaining sleeve is automatically again brought into the first position by the bias spring. An essential aspect of the present application is in that upon connecting the two plug parts, the spring element is introduced into a clearance between the outer side of the first plug part, in particular of a plug housing of the plug part, and the retaining sleeve, before contacting the retaining sleeve for the axial displacement thereof effected by the spring element. By such a configuration, it is avoided that the spring element impacts on a front-side rim of the retaining sleeve and then displaces it. By the introduction into the clearance performed first, thus, secure movement guidance is ensured and too far outward snapping of the spring element upon the subsequent radial movement and the outward pressing is thereby avoided. Moreover, the displacement of the retaining sleeve upon the following further pushing together is virtually secured concerning movement.

Thus, by the present application, the spring element is inserted virtually into the interior between the retaining sleeve and the first plug part in particular unbent and only with axial movement, before the retaining sleeve is displaced at all. Thereby, a preset and purposefully directed guide track for contacting the retaining sleeve following afterwards and also then the radially outward bending of the spring element is also virtually preset. Not least, thus, the movement sequences of the spring element virtually proceed in the interior of the retaining sleeve such that besides a secured and low-wear movement guidance of the spring element, injury of a user on the spring element can also be avoided.

It is provided that at least the front end of the spring element is formed as a strip, in particular plate like strip, which is bent for forming a thickening. Therein, the bending is performed such that a clearance is formed between the opposing strip parts. Thereby, a very specific shaping is allowed on the one hand, a material saving and thus weight-reduced component can thereby be provided on the other hand.

In particular advantageousness, it is provided that the second bent strip part is disposed without contact with the first strip part on its free end. Thereby, and also in connection with the clearance or cavity formed between the strip parts, some deformation elasticity of this thickening can be provided such that in connecting and in particular in snapping into the second clearance and the form fit resting against the plug part and the retaining sleeve, some deformation possibility is also ensured. Thereby, especially the form fit restings can also be particularly well achieved with some tolerance with regard to the deformability of the thickening.

Preferably, it is provided that after introducing the spring element into the clearance, upon further axially pushing together the plug parts, the spring element rests on the outer side of the first plug part, in particular the plug housing, and is further guided axially, in particular only axially, in the clearance. In particular, the spring element is guided spaced from and thus contactless with the inner side of the retaining sleeve. This is in particular effected until the spring element is radially pressed outwards by elements in the clearance and then afterwards contacts the inner side of the retaining sleeve.

Preferably, it is provided that upon pushing together the plug parts for the connection thereof after introducing the spring element into this first clearance, upon following further axially pushing together the plug parts, the spring element is approached with its front end to a stop disposed on the outer side of the second plug part and radially extending into the clearance and contacted therewith. In this regard, it is therefore also ensured that this stop on the plug part side is externally protected and at least surrounded by the retaining sleeve. Thereby too, thus, undesired movements or deformations of the moving component parts as well as undesired external damage to this stop can be avoided.

Preferably, if the front end of the spring element has been approached to this stop on the plug part side, the spring element is guided along an inclined flank of the stop upon further axially pushing together the plug parts. Thereby, the spring element is pressed radially outwards in the first clearance.

Preferably, then, upon further axially pushing together the plug parts, the front end of the spring element is then automatically approached to a stop extending radially inwards and formed on the inner side of the retaining sleeve in its radially outwardly pressed state, and upon further pushing together the plug parts, the retaining sleeve is displaced backwards in axial direction by the spring element.

In particular, it is provided that both the stop on the plug part side and the stop on the retaining sleeve side are disposed considerably recessed with respect to the respectively front rims of the plug part and the retaining sleeve.

Preferably, these two stops are recessed as far as their distance to the front rim of the first plug part as well as to the front rim of the retaining sleeve is larger than an axial length of a thickening of the front end of the spring element. In particular, the stop on the plug part side first reached by the spring element in axial direction upon pushing together the plug parts is only contacted when the thickening on the front end of the spring element has been completely introduced into the first clearance.

Thus, the front end of the spring element is preferably formed as a thickening, which has a sloping flank and terminating the thickening on the side facing the outer side of the first plug part.

In particular, upon further pushing together the plug parts starting from the pushed together intermediate state, in which the retaining sleeve is already displaced backwards in axial direction by the spring element, this thickening of the spring element is pushed over the stop on the plug part side. This thickening is then introduced into a further second clearance between the outer side of the first plug part and the retaining sleeve behind the stop on the plug part side, whereby it is snapped thereby while radially inwardly moving.

This movement sequence too is circumferentially protected by the retaining sleeve such that here too, movement guidance between the retaining sleeve and the first plug part results by the configuration of the further clearance.

In particular, by snapping of the thickening of the spring element into the further clearance, the front end of the spring element is released from the stop on the retaining sleeve. The possibility of forward movement of the retaining sleeve in axial direction is thereby again automatically released. Then, the retaining sleeve is again automatically axially displaced from this second position into the first position by the bias spring.

Preferably, the thickening of the spring element in radial direction is formed such that it is disposed free of play in radial direction in the second clearance in the connected final state of the plug parts. This means that the shaping of the thickening and in particular the radial extent of the thickening is configured such that it is disposed in the second clearance in virtually form-fit and precisely fitting manner with regard to the resting against the first plug part on the one hand and the retaining sleeve on the other hand.

Preferably, the outwardly bent second strip part is linearly formed and thus extends linearly in particular in axial direction. By such a configuration, especially with regard to the contact and movement guidance upon pushing together, a component particularly space-saving in radial direction can be provided, which moreover also does not scrape along or get jammed for example on the retaining sleeve in undesired manner.

Preferably, in the first position of the retaining sleeve, a state locking the connected plug parts and preventing the axial separation of the plug parts is adjusted. By the bias, this locking is autonomously or automatically adjusted.

In particular, for disconnecting the connected plug parts, starting from a completely connected state of the plug parts, the retaining sleeve is axially retracted from the first position into the second position against the spring force of the bias spring by a user. Thereby, the release position is adjusted and in this second position of the retaining sleeve, by axially pulling apart the plug parts, the spring element with its thickening can be moved out of the second clearance by again guiding it over the stop on the plug part side and thereby pressing it radially outwards.

Only by transferring the retaining sleeve into this second position, the second clearance is radially increased such that the spring element with its front end does no longer rest against the inner side of the retaining sleeve and a radially outwards larger second clearance is formed, into which the spring element then can move upon slipping over the stop on the plug part side.

Preferably, the retaining sleeve is disposed in axially displaceable manner by a plurality of coil springs retained on the outer side of the first plug part and extending in axial direction. Such a configuration provides essential advantages compared to merely a single spring wound around the longitudinal axis of the plug-in connector. By such a plurality of such springs, which are correspondingly specifically disposed as well, a particularly uniform axial movement guidance of the retaining sleeve is ensured. Undesired tilting and spreading can thereby be avoided.

Furthermore, the present application relates to an electrical plug-in connector with a first and a second plug part, in which on a first plug part, a hollow cylindrical retaining sleeve is disposed movably in axial direction relative to the first plug part. The retaining sleeve is retained in a first position biased by at least one bias spring and the axial relative movement is effected against the spring force. Upon connecting the plug parts, a spring element disposed on the second plug part is pressed radially outwards in a connecting intermediate state. Upon further axially pushing together the plug parts, the retaining sleeve is displaced axially backwards from the first position by the spring element, wherein upon further pushing together the plug parts, the spring element snaps radially inwards into a recess, and the backward displacement of the retaining sleeve by the spring element is terminated. In particular, the retaining sleeve can then again be automatically brought into the first position by the bias spring. Between an outer side of the first plug part, in particular a plug housing, and the retaining sleeve, a first clearance is formed, into which the spring element extends upon connecting the plug parts before contacting the retaining sleeve for the axial displacement thereof effected by the spring element.

The clearance is open to the front end of the plug part and the retaining sleeve such that the axial introduction of the spring element can be effected without further deflection or radial positional variations.

Preferably, a stop extending radially into the first clearance is formed on the outer side of the first plug part, by which the spring element is pressed radially outwards upon pushing together the plug parts before contacting the retaining sleeve. This first stop on the plug part side is formed offset backwards with respect to the front rim of the first plug part. In particular, it is disposed offset backwards spaced from the front rim over such a distance, which corresponds to at least the axial length of a thickening of the front end of the spring element.

The front end of the spring element has a thickening in particular formed by a bent strip of the spring element. The thickening is in particular formed in radial direction such that it is disposed in form-fit manner at least in certain areas on the outer side of the first plug part and on the inner side of the retaining sleeve in a second clearance between the retaining sleeve and the first plug part in the connected state of the plug parts. The thickening is formed by the bent strip of the spring element such that two strip parts extending spaced apart and parallel at least in certain areas are formed. The two strip parts are disposed contactless over their entire length. In particular, the second strip part, which is the outboard strip part, extends completely linearly and thus completely in axial direction.

The second clearance is dynamically variable in its size, in particular in radial direction, wherein this is effected automatically and defined for the procedure of connecting and disconnecting the plug parts by the axial relative positional variation between the first plug part and the retaining sleeve upon relative displacement thereof to each other.

It is also particularly advantageous that at least the second plug part can be modularly constructed and differently formed. In this regard, the second plug part can also be formed as an angular plug part.

It can also be provided that the second plug part has a flange, with which the second plug part can for example be attached to a housing or the like. The flange can be disposed in different angles with respect to the longitudinal axis of the plug part. Here, angles of 90° or less can for example be provided. Flange inclinations of 90° or 40° are particularly advantageous.

It can also be provided that the second plug part, which can also be referred to as a coupling, is formed without such a flange.

It is particularly advantageous, if a plurality of spring elements, for example three spring elements, is disposed on the second plug part. These spring elements are preferably strip-shaped leaf springs.

Similarly, it is advantageous that the first plug part has a plurality of bias springs, for example three bias springs.

Preferably, the plug parts are round plug parts for an electrical round plug-in connector.

Each of the two plug parts is formed for receiving a specific electrical contact support defining the respective contact arrangement. In this regard, it is particularly advantageous that the contact arrangement has three connecting channels. By specific codings, herein, plug-in connectors can be formed, which are provided for design for different electrical voltages. Herein, therefore, high-volt plug-in connectors for 3 kV or for 6 kV can for example be provided.

Preferably, the contact arrangements are configured such that the three plug channels are disposed to each other like in an isosceles triangle. In this respect, this indication relates to the centers of the channels.

Preferably, the bias springs are coil springs. Preferably, they are embedded in axially oriented grooves or recesses formed on the outer side of the plug housing, and retained by retainers on a rear groove end.

Further features of the present application are apparent from the claims, the figures and the description of figures. The features and feature combinations mentioned above in the description as well as the features, feature combinations only shown in the figures and/or the features and feature combinations only mentioned in the description of figures, are usable not only in the respectively specified combinations, but also in other combinations or alone without departing from the scope of the present application.

BRIEF DESCRIPTION OF THE DRAWINGS

Embodiments of the present application are explained in more detail below based on schematic drawings.

In the figures, identical or functionally identical elements are provided with the same reference characters.

DETAILED DESCRIPTION

Figures 1, 2:
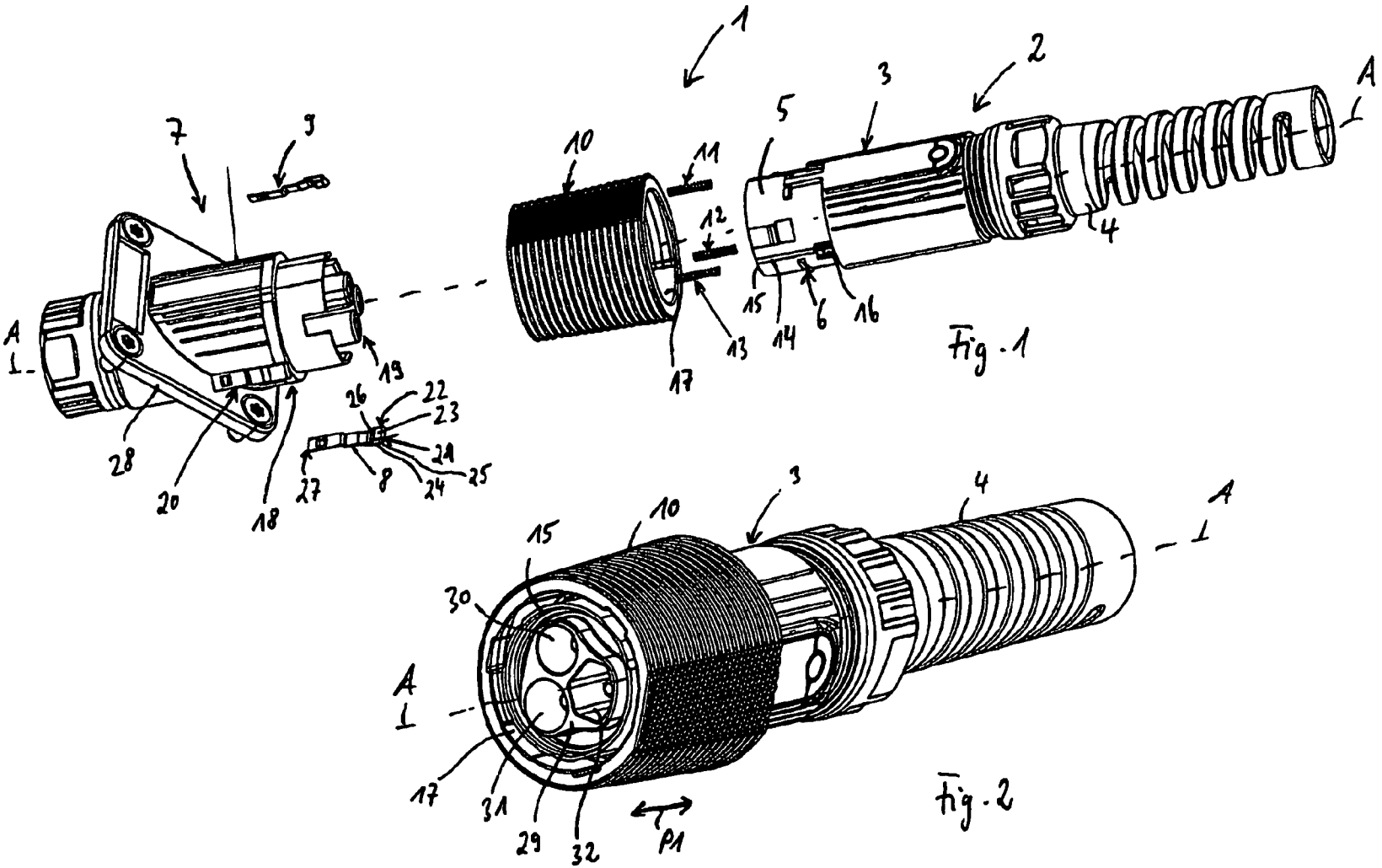
FIG. 1 is a schematic exploded illustration of a first embodiment of a plug-in connector according to the present application.
FIG. 2 is a perspective illustration of an assembled state of a first plug part of the plug-in connector according to FIG. 1.

In FIG. 1, a first embodiment of an electrical plug-in connector 1 is shown in an exploded illustration. The plug-in connector 1 includes a first plug part 2. It includes a base part or a plug housing 3, which is for example formed of metal. This base part or plug housing 3 is formed for receiving a not shown cable. On the rear side of the plug housing 3, an elastic strain relief element 4 formed of plastic is disposed. At the same time, it is also formed as a bend protection of the cable immediately after exit from the plug housing 3. Moreover, the plug housing 3 serves also for receiving a support for electrical contacts, which is disposed in the interior of the plug housing 3. It is for example formed of plastic and receives the electrical contacts. Thereby, the contact arrangement of the first plug part 1 is also defined. On an outer side 5 of the plug housing 3, a radially outwardly extending stop 6 is formed. In the embodiment, it is provided that plural, in particular three such raised structures are formed as stops 6 in circumferential direction around the longitudinal axis A of the first plug part 2. Moreover, they also serve as guiding ramps for spring elements 8, 9 and 20 disposed on a second plug part 7. In the embodiment, it is provided that the second plug part 7 has three such spring elements 8, 9 and 20. Since the further spring elements 9 and 20 are formed analogously to the spring element 8, the further explanation to the spring element 8 analogously also relates to the spring elements 9 as well as 20.

Moreover, it is provided that a hollow cylindrical retaining sleeve 10 for example formed of plastic is movably attached to the first plug part 2. The movability of the retaining sleeve 10 is provided exclusively in axial direction and thus in the direction of the longitudinal axis A. The relative movability of the retaining sleeve 10 to the plug housing 3 is ensured by three bias springs 11, 12 and 13 in the embodiment. These bias springs 11 to 13 are coil springs, which are disposed equidistantly to each other in circumferential direction around the axis A and extend parallel to the axis A.

For mounting the bias springs 11 to 13 on the plug housing 3, retaining devices are provided. For illustration in the explanation, to this, in FIG. 1, an axial recess in the form of a groove or gutter 14 is provided on the outer side 5 for mounting the bias spring 13. At the end of the groove 14 opposing the front end 15 of the plug housing 3 or facing away from it, a retainer 16 for the bias spring 13 is provided. The bias spring 13 thus is located partially recessed in the groove 14 and is retained in the retainer 16 in the assembled state of the plug part 2 with the retaining sleeve 10. Correspondingly, the further bias springs 11 and 12 are retained and guided. Moreover, the bias springs 11 to 13 are connected to the retaining sleeve 10 on an inner side 17 of the retaining sleeve 10. In the assembled state of the first plug part 2 with the retaining sleeve 10, the retaining sleeve 10 is retained in a locking position or closure position in the state not operated by a user and thus in a starting position. This is ensured by the bias springs 11 to 13 and the sleeve 10 is thereby retained in this biased state.

In the embodiment, the second plug part 7 is also formed as a round plug part analogously to the first plug part 2. The second plug part 7 also includes a plug housing 18 formed of metal. The plug housing 18 is formed for receiving an electrical contact support 19, by which the contact arrangement of the second plug part 7 is also defined. The three strip-shaped leaf springs of the plug part 7 serving as spring elements 8, 9 and 20 for connecting to the first plug part 2 are correspondingly attached or inserted.

According to the illustration in FIG. 1, it can be recognized that a spring element 8, 9, 20 is formed strip-shaped and has a front end 21. It is formed with a thickening 22. The thickening 22 is formed by outwardly bending the front end of the strip such that a first strip part 23 and an opposing strip part 24 are present. Between the strip parts 23 and 24, then, a clearance or cavity 25 is formed. The second strip part 24 extends completely linearly, whereas the first strip part 23 has a section sloping obliquely towards the second strip part 24 or a flank 26 at its end facing away from the front rim. Towards the rear end 27 of the spring element 8, then, further bends and kinks are formed in the plate-like strip, which are not indicated in more detail here.

In the embodiment according to FIG. 1, the second plug part 7 includes a flange 28. It is disposed inclined at an angle $\alpha$ of 40° with respect to the longitudinal axis A. The flange 28 in the form of a plate serves for attaching the second plug part 7 to a housing or the like.

The second plug part 7 also referred to as a coupling thus in particular also includes an exchangeable attachment adapter.

In FIG. 2, in a schematic perspective illustration, the first plug part 2 is shown in the assembled state. The already mentioned electrical contact support 29 can herein be recognized, whereby the contact arrangement is also represented. In the embodiment, here, three channels 30, 31 and 32 are provided, which support and receive the electrical contacts. The retaining sleeve 10 is displaceable along the arrow representation P1 in axial direction.

Figure 3C:
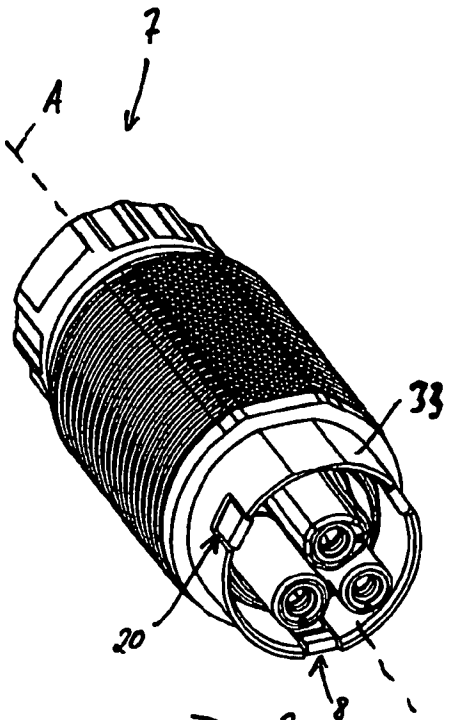
FIGS. 3*a*-3*c* are perspective illustrations of different embodiments of a second plug part of the plug-in connector.
Figure 3B:
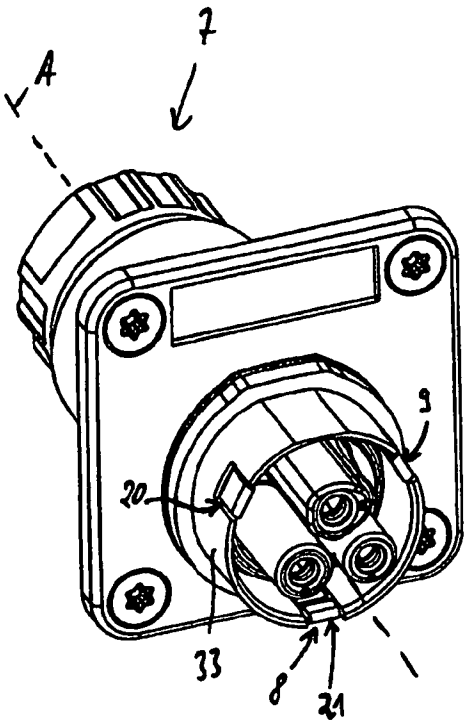
Figure 3A:
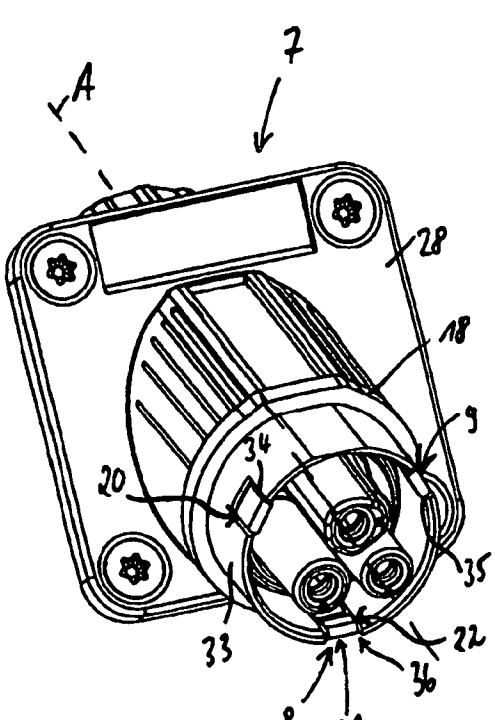

In FIGS. 3*a* to 3*c*, in perspective illustration, various embodiments of a second plug part 7 are shown. In the illustration according to FIG. 3*a*, therein, the plug part 7 according to the implementation in FIG. 1 is shown.

It is recognizable that a front section 33 of the plug housing 18 has recesses 34, 35 and 36, into which the front ends of the spring elements 8, 9 and 20 extend. In particular, these recesses 34 to 36 are formed with a length corresponding to the length of the thickenings 22 of the spring elements 8, 9 and 20. In this regard, it is recognizable that the thickening 22 of the spring element 8 engages the recess 36.

In FIG. 3*b*, a further embodiment of the coupling or the second plug part 7 is shown. Unlike the configuration according to FIG. 3*a*, here, the flange 28 is not disposed at an angle of 40° to the axis A, but at an angle of 90°.

In FIG. 3*c*, a further embodiment of the second plug part 7 is shown. In this configuration, a flange 28 is not provided.

Figure 4A:
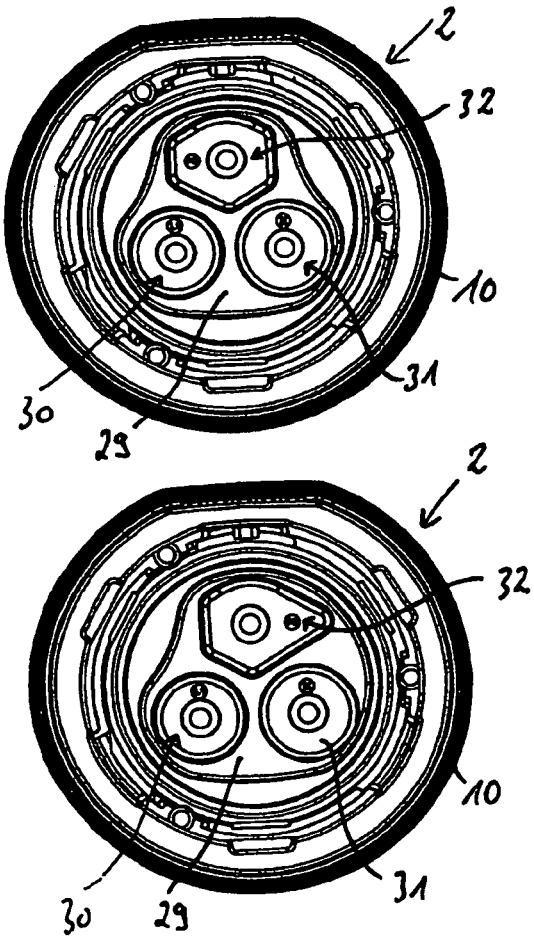
FIG. 4*a* includes two different implementations of a contact arrangement of the first plug part.

In the illustrations in FIG. 4*a*, a front view of embodiments of the first plug part 2 is shown. In the upper image in FIG. 4*a*, therein, a configuration is shown, in which a high-volt plug is designed for 6 kV. The electrical contact support 29 includes 3 contact channels 30, 31 and 32, wherein the centers of the channels are disposed in an equilateral triangle to each other.

In this embodiment, the channel 30 includes the conductor L with the electrical contact, the channel 31 includes the neutral conductor N with the electrical contact, and the channel 32 includes the PE conductor with the corresponding contact.

In the lower image of FIG. 4*a*, a further embodiment for a contact arrangement of the first plug part 2 is shown. Unlike the upper illustration, this plug part 2 is designed for 3 kV.

Figure 4B:
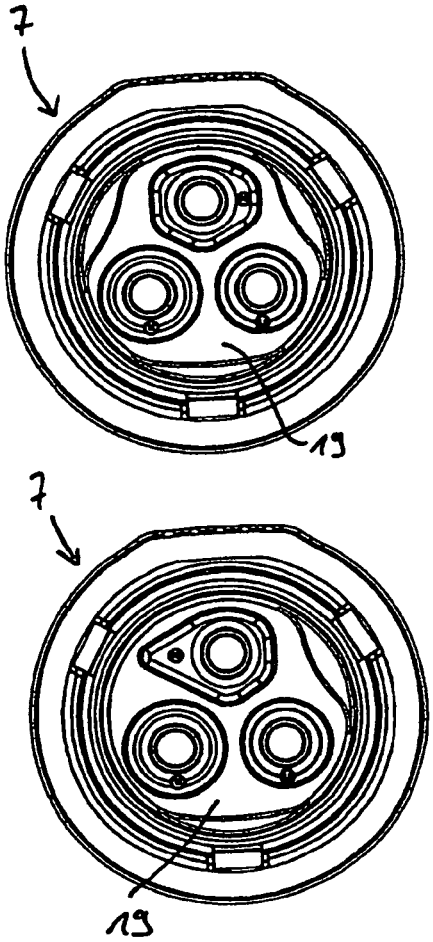
FIG. 4*b* includes two different embodiments for contact arrangements of the second plug part, which are each formed for compatibly assembling with the contact arrangements of the first plug parts according to FIG. 4*a;*

In the illustrations in FIG. 4*b*, the contact arrangements of the second plug parts 7 complementary to the contact arrangements in FIG. 4*a* are shown. Thus, in FIG. 4*b*, the upper illustration is provided for compatibly connecting to the upper illustration in FIG. 4*a*, and the lower illustration in FIG. 4*b* is provided for compatibly plugging together with the lower illustration in FIG. 4*a*.

In the further FIGS. 5*a* to 9*b*, now, plugging together the two plug parts 2 and 7 is explained in more detail.

Figure 5A:
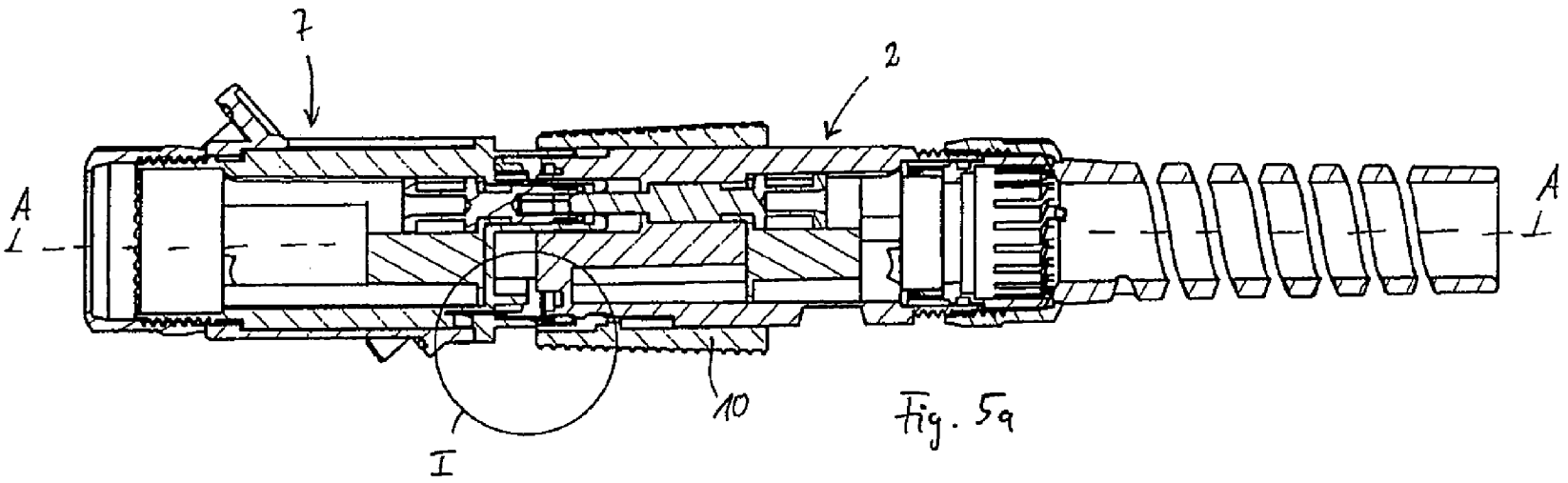
FIG. 5*a* is a sectional illustration of a plug-in connector, in which the plug parts are pushed together in the first intermediate connecting state.

To this, in FIG. 5*a*, a sectional illustration of the plug-in connector 1 is shown. Therein, the first plug part 2 is already minimally inserted into the second plug part 7 and a first intermediate connecting state is achieved. For further explaining this first intermediate connecting state, reference is made to FIG. 5*b*, in which a partial section I in FIG. 5*a* is illustrated in enlarged manner. As can be recognized in FIG. 5*b*, the spring element 8 is retained in the plug housing 18 via a locking tab 37. It can be recognized that the spring element 8 with its thickening 22 on the front end 21 is inserted into a first clearance 38. This clearance 38 forms between the outer side 5 of the plug housing 3 and the inner side 17 of the retaining sleeve 10.

Thus, first, in connecting the two plug parts 2 and 7, introduction of the thickenings 22 of the spring elements 8, 9 and 20 is performed virtually into the interior of the first plug part 1 in axial direction. In the embodiment, therein, it is provided that the spring elements 8, 9 and 20 introduce themselves into the first clearance 38 until the entire length of the thickenings 22 is contained therein. Therein, the outer side of the first strip part 23 is contacted with the outer side 5 and guided along this outer side 5 upon axial movement upon pushing together. This is effected until the front end 21 and thus also the thickening 22 is approached to the stop 6 radially extending into the first clearance 38. This stop 6 includes a front oblique stop flank 39, a subsequent horizontal plane 40 and a stop flank 41 sloping obliquely inwards in turn following thereto.

Figure 5B:
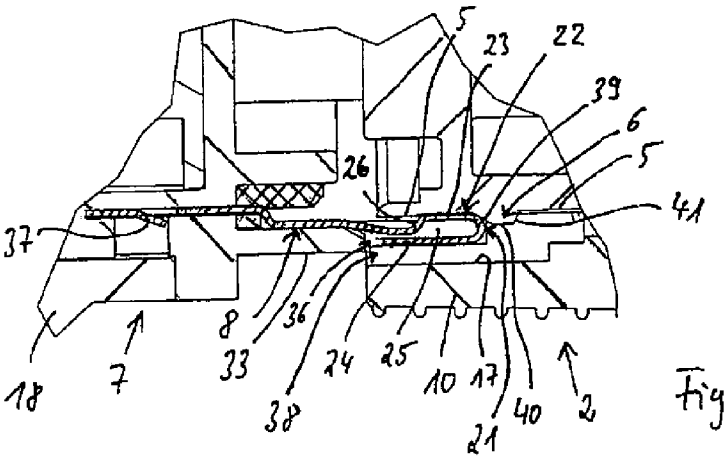
FIG. 5*b* is an enlarged illustration of a section of the illustration in FIG. 5*a;*
Figure 6A:
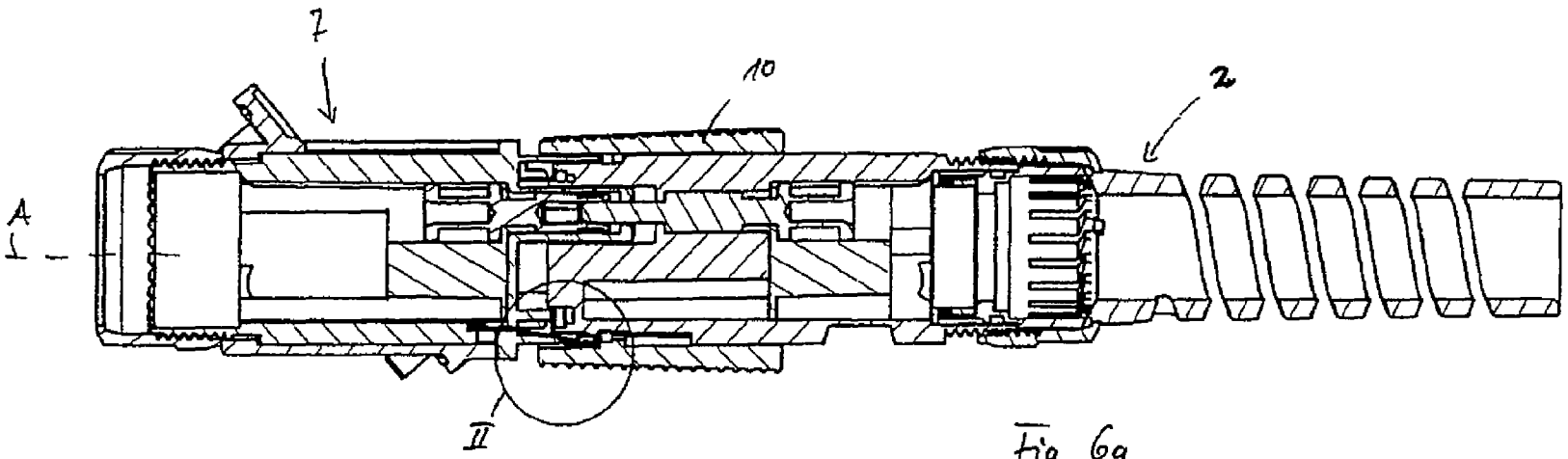
FIG. 6*a* is a sectional illustration of the plug-in connector in a further intermediate connecting state.
Figure 6B:
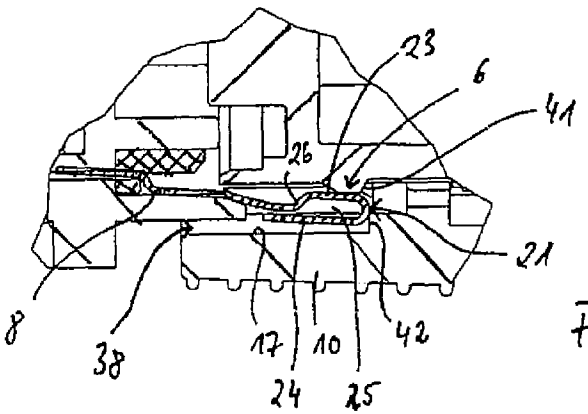
FIG. 6*b* is an enlarged illustration of a partial section of the illustration in FIG. 6*a;*

Starting from the intermediate connecting position shown in FIGS. 5*a* and 5*b*, then, upon further axially pushing together the plug parts 2 and 7, the state is achieved as it is shown in FIGS. 6*a* and 6*b*. In FIG. 6*a*, therein, the complete section of the two plug parts 2 and 7 is shown. For further explanation, therein, reference is made to the enlarged partial section II as it is then illustrated in FIG. 6*b*. Starting from the first intermediate connecting state in FIG. 5*a*, then, the spring element 8 is pressed radially outwards by the stop 6 and in particular the stop flank 39 extending obliquely outwards according to the illustration in FIG. 6*b*, which is possible due to the radial dimensioning of the first clearance 38. In this regard, the radial extent of the first clearance 38 is considerably larger than the radial extent of the thickening 22. As can be recognized from the illustration in FIG. 6*b*, then, the front region 33 of the plug housing 18 also enters this first clearance 38. By radially outwardly pressing the spring element 8 and in particular the thickening 22, upon further axially pushing together the plug parts 2 and 7, the front end 21 impacts a stop 42 formed on the inner side 17, which is formed in the form of a discrete step. In this state, the retaining sleeve 10 is still in its biased initial state and thus in the first position. The thickening 22 is still in the first clearance 38 between the plug housing 3 and the retaining sleeve 10.

Figure 7A:
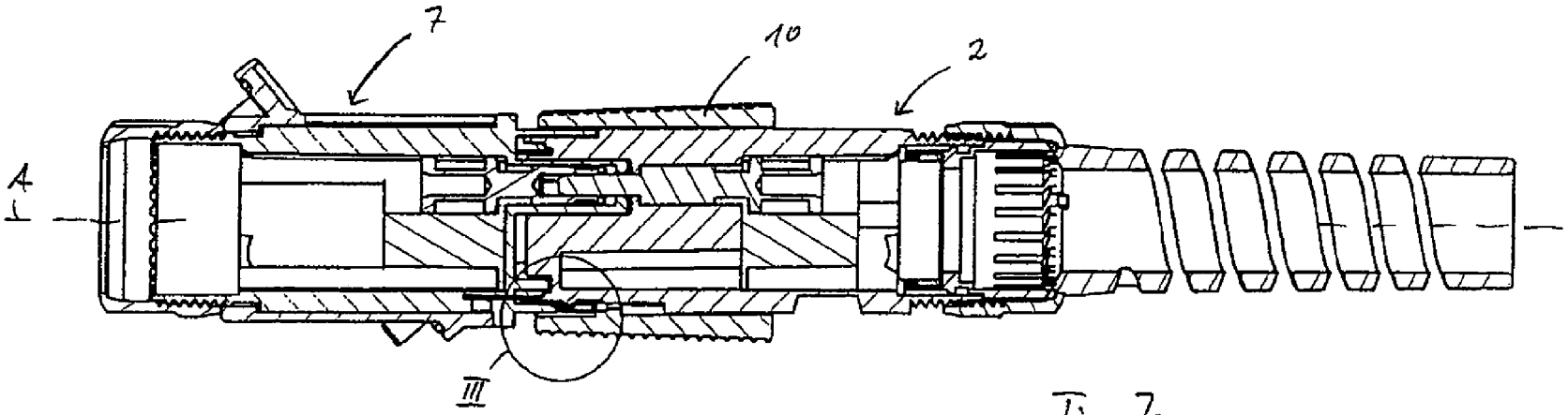
FIG. 7*a* is a sectional illustration of the plug-in connector in a further intermediate connecting state following to that in FIG. 6*a;*
Figure 7B:
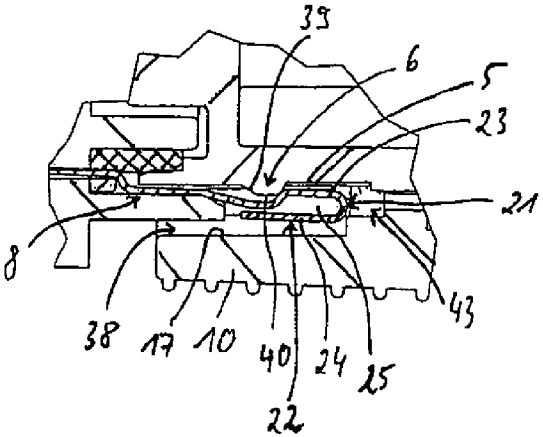
FIG. 7*b* is an enlarged illustration of a partial section of the illustration in FIG. 7*a;*

Starting from the further intermediate connecting state achieved in FIGS. 6*a* and 6*b*, then, upon further axially pushing together the plug parts 2 and 7, a further intermediate connecting state is achieved, as it is shown in FIGS. 7*a* and 7*b*. In FIG. 7*a*, therein, again the entire sectional illustration of the plug parts 2 and 7 is shown. For further explanation, reference is again made to the enlarged partial section III in FIG. 7*a*, which is illustrated in FIG. 7*b*. Therein, starting from the achieved position in FIG. 6*b*, by further axially pushing together, the spring element 8 is further retained in the position radially pressed outwards and the thickening 22 slides over the plane 40 of the stop 6 with its inboard first strip part 23. In that the front end 21 rests against the stop 42 of the retaining sleeve 10, this retaining sleeve 10 is automatically displaced backwards from the first position against the spring forces of the bias springs 11 to 13 by the spring element 8.

As can be recognized from the illustration in FIG. 7*b*, this is effected until the thickening 22 with the strip part 23 is completely transferred over the plane 40 and can be inserted into a second clearance 43 formed behind the stop 6. Therein, the oblique flank 26 of the spring element 8 then slides again radially inwards along the flank 41 obliquely sloping inwards.

Figure 8A:
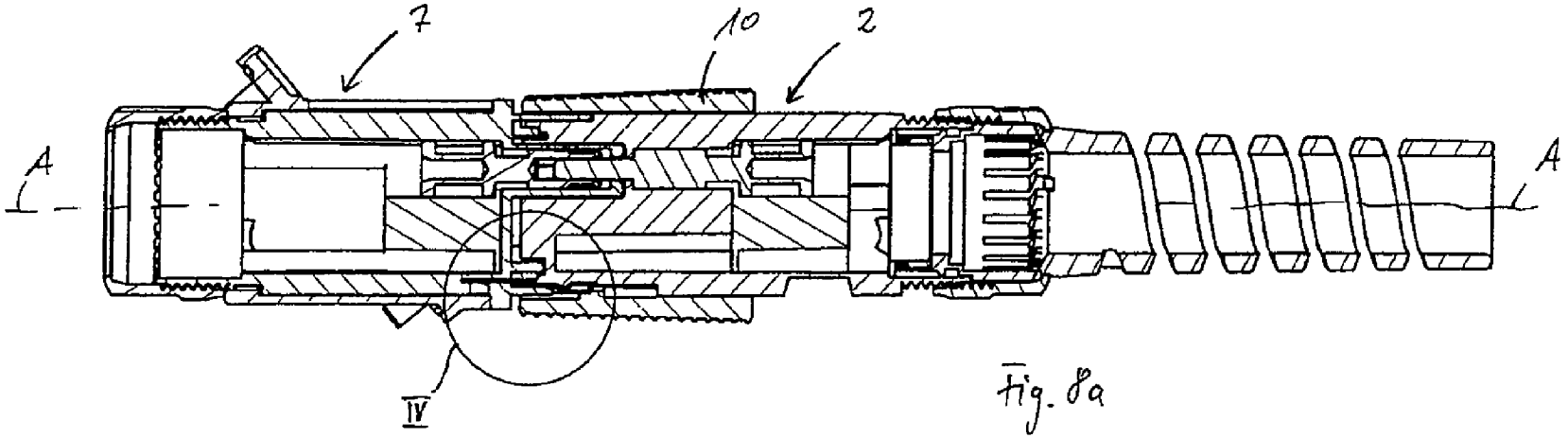
FIG. 8*a* is a sectional illustration of the completely connected state of the plug parts.
Figure 8B:
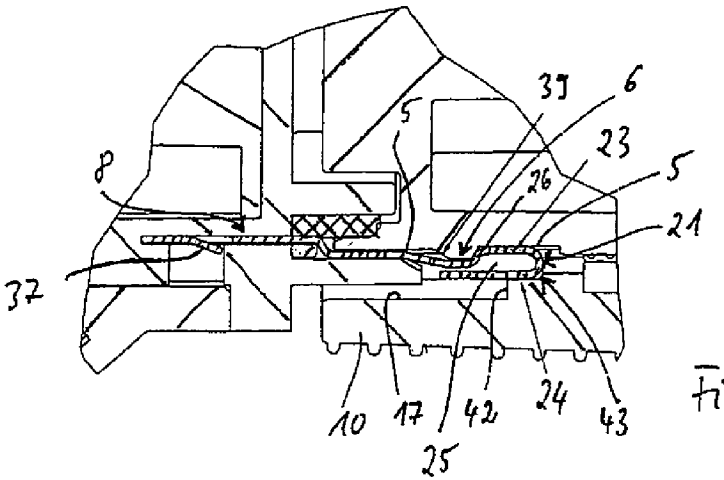
FIG. 8*b* is an enlarged illustration of a partial section of the illustration in FIG. 8*a;*

According to the illustration in FIGS. 8*a* and 8*b*, the further assembly of the plug parts 2 and 7 is explained. Therein, the illustration in FIG. 8*a* again shows the sectional view of the two plug parts 2 and 7. In FIG. 8*b*, again, an enlarged partial section IV in FIG. 8*a* is illustrated. Starting from the further intermediate connecting state achieved in FIG. 7*b*, then, upon further axially pushing together the plug parts 2 and 7, the thickening 22 is completely introduced into the second clearance 43 and therein snaps into this clearance 43. Therein, the radially outwardly bent position, as it was formed in FIGS. 6*b* and 7*b*, is again cancelled. Thereby, it is then also achieved that the front end 21 does no longer rest against the stop 42 of the retaining sleeve 10 and thus further backwards pushing of the retaining sleeve 10 by the spring elements 8, 9 and 20 either is not effected. Rather, then, the backwards pushing of the retaining sleeve 10 is terminated. After snapping of the thickening 22 into the second clearance 43, which is again formed between the outer side 5 of the plug housing 3 and the inner side 17 of the retaining sleeve 10, the further movement possibility of the retaining sleeve 10 is released. Therein, the retaining sleeve 10 is then automatically again forwardly displaced in axial direction towards the second plug part 7 from the pushed-back position by the compressed bias springs 11 to 13 and automatically brought into the starting position and thus into the first position. This first position is then also the locking state in the connected state of the plug parts 2 and 7. According to the illustration in FIG. 8*b*, it is also achieved in it that the thickening 22 is disposed in the second clearance 43 between the outer side 5 and the inner side 17 at least in certain areas in form-fit manner and thus resting against both surfaces. Moreover, in that the thickening 22 is also snapped behind the stop 6, autonomous release of the two plug parts 2 and 7 is prevented. Because the thickening 22 can no longer be autonomously pulled over the stop 6 since it can no longer move outwards in radial direction since the second clearance 43 is narrower in radial direction and is bounded by the wall of the sleeve 10 beginning from the step or the stop 42.

Figure 9A:
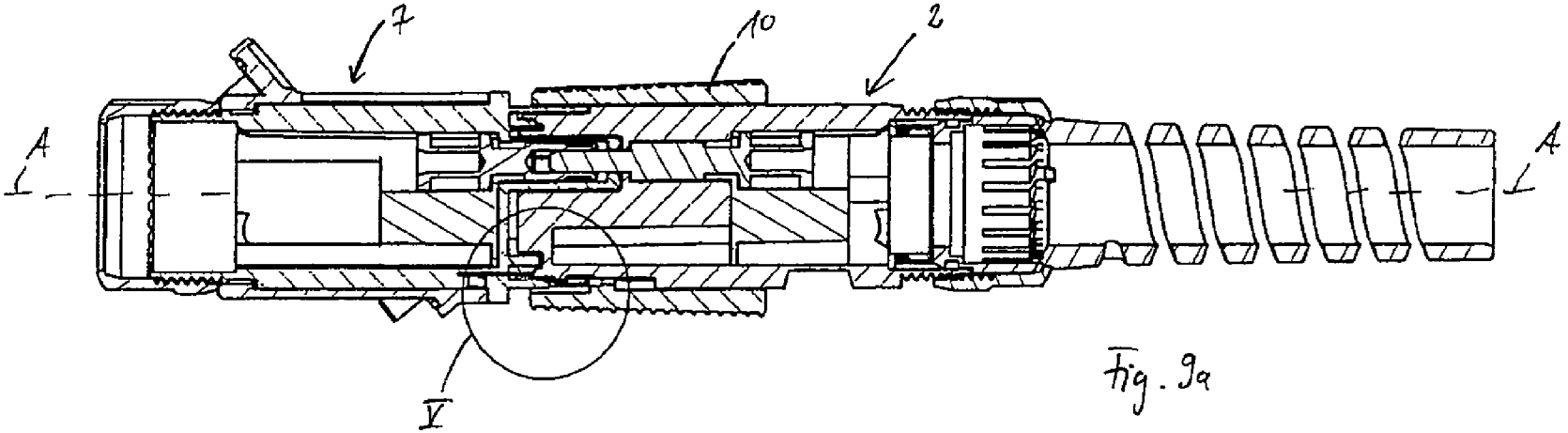
FIG. 9*a* is a sectional illustration of an intermediate release state of the plug starting from the completely locked state in FIG. 8*a*.
Figure 9B:
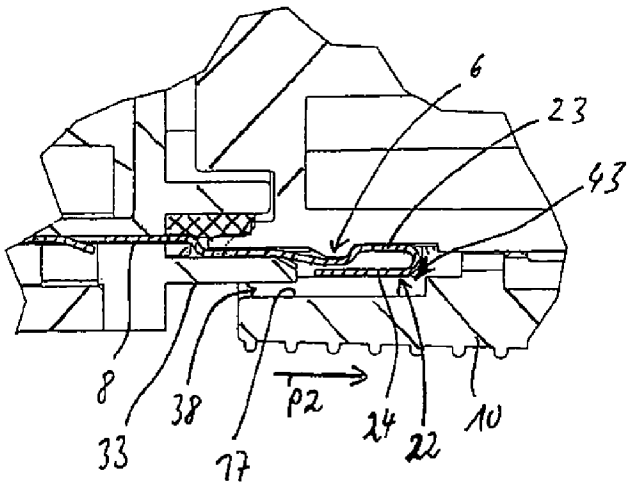
FIG. 9*b* is an enlarged illustration of a partial section of the illustration in FIG. 9*a.*

Starting from the completely locked state shown in FIGS. 8*a* and 8*b* and thus also completely assembled state of the plug parts 2 and 7, then, release and thus disconnection of the plug parts 2 and 7 can only be effected in that first the retaining sleeve 10 is retracted in axial direction starting from the first position and thus the locking position by a user. This is shown in the illustrations in FIGS. 9*a* and 9*b*. Therein, FIG. 9*a* again shows the sectional illustration of the two plug parts 2 and 7, wherein an enlarged section V is shown in FIG. 9*b*. Therein, compared to the illustration of FIG. 8*b*, it can be recognized that the retaining sleeve 10 has been retracted away from the second plug part 7 in the direction of the arrow P2. This is effected until a second final position is achieved, which can be haptically recognized by the user by a stop of the retaining sleeve 10. In this release position, the stop 42 is moved back as far as it comes to lie behind the front end 21 of the spring element 8. The second clearance 43 is virtually dynamically increased to the bottom or radially outwards by the movement and positional variation of the components with respect to each other such that upon further axially pulling apart the plug parts 2 and 7, the thickening 22 can again move radially outwards upon slipping over of the stop 6, and then can slip over the stop 6 without problem upon further pulling apart. Then, the two plug parts 2 and 7 can be disconnected from each other without problem.

The invention claimed is:

1. A method for connecting plug parts of an electrical plug-in connector, in which on a first plug part, a hollow cylindrical retaining sleeve is disposed movably in axial direction relative to the first plug part, wherein the retaining sleeve is retained in a first position biased by at least one bias spring and the axial relative movement is effected against the spring force, and upon connecting the plug parts, a spring element disposed on the second plug part is pressed radially outwards in a connecting intermediate state, upon further axially pushing together the plug parts, the retaining sleeve is displaced axially backwards from the first position by the spring element, and upon further axially pushing together the plug parts, the spring element snaps radially inwards into a recess and the backward displacement of the retaining sleeve effected by the spring element is terminated, wherein the spring element is introduced into a first clearance between an outer side of the first plug part and an inner side of the retaining sleeve before contacting the retaining sleeve for the axial displacement thereof effected by the spring element, wherein the front region of the spring element is formed as a strip, which is bent for forming a thickening, and a cavity is formed between the opposing strip parts, and the bent second strip part is disposed contactless with the first strip part on its free end, and the strip parts are formed parallel extending at least in certain areas.

2. The method according to claim 1, wherein upon pushing together the plug parts for the connection thereof after introducing the spring element into the first clearance, upon further axially pushing together the plug parts, the spring element with its front end is approached to a stop disposed on the outer side of the first plug part and radially extending into the first clearance and contacted therewith.

3. The method according to claim 2, wherein upon further axially pushing together the plug parts, the spring element is guided along an oblique flank of the stop and thereby is pressed radially outwards in the first clearance.

4. The method according to claim 3, wherein upon further axially pushing together the plug parts, the front end of the spring element is approached to a stop formed on the inner side of the retaining sleeve and extending radially inwards in its radially outward pressed state, and upon further axially pushing together the plug parts, the retaining sleeve is displaced backwards in axial direction by the spring element.

5. The method according to claim 4, wherein the front end of the spring element is formed as a thickening, which has a sloping flank terminating the thickening on the side facing the outer side of the first plug part, and upon further axially pushing together the plug parts, the thickening is pushed over the stop on the plug part side, and then it snaps into a further clearance while radially moving inwards, in particular a clearance dynamically varying in its size by the relative movement of the retaining sleeve and the plug part to each other, between the outer side of the first plug part and the inner side of the retaining sleeve, behind this stop.

6. The method according to claim 5, wherein by snapping of the thickening of the spring element into the further clearance, the front end of the spring element is released from the stop on the retaining sleeve and the retaining sleeve is again automatically displaced into the first position by the bias spring.

7. The method according to claim 5, wherein the thickening is formed in radial direction such that it is disposed at least in certain areas free of play in radial direction in the second clearance in the connected final state of the plug parts.

8. The method according to claim 1, wherein in the first position of the retaining sleeve, a state locking the connected plug parts and preventing the axial separability of the plug parts is adjusted.

9. The method according to claim 1, wherein for disconnecting the connected plug parts, the retaining sleeve is axially retracted by a user from the first position into a second position against the spring force of the bias spring, and thereby in the second position, by axially pulling apart the plug parts, the spring element with its thickening is movable radially outwards between the first plug part and the retaining sleeve.

10. The method according to claim 1, wherein the retaining sleeve is axially displaceably disposed by a plurality of bias springs retained on the outer side of the first plug part and extending in axial direction.

11. A plug-in connector comprising a first and a second plug part, in which on the first plug part, a hollow cylindrical retaining sleeve is disposed movably in axial direction relative to the first plug part, wherein the retaining sleeve is retained in a first position biased by at least one bias spring and the axial relative movement is effected against the spring force, and upon connecting the plug parts, a spring element disposed on the second plug part is pressed radially outwards in a connecting intermediate state, upon further axially pushing together the plug parts, the retaining sleeve is displaced axially backwards from the first position by the spring element, and upon further pushing together the plug parts, the spring element snaps radially inwards into a recess and the backward displacement of the retaining sleeve by the spring element is then terminated, wherein between an outer side of the first plug part and an inner side of the retaining sleeve, a first clearance is formed, into which the spring element extends before contacting the retaining sleeve for the axial displacement thereof effected by the spring element, wherein the front region of the spring element is formed as a strip, which is bent for forming a thickening, and a cavity is formed between the opposing strip parts, and the bent second strip part is disposed contactless with the first strip part on its free end, and the strip parts are formed parallel extending at least in certain areas.

12. The plug-in connector according to claim 11, wherein on the outer side of the first plug part, a stop extending radially into the first clearance is formed, by which the spring element is pressed radially outwards upon pushing together the plug parts before contacting the retaining sleeve.

13. The plug-in connector according to claim 11, wherein the front end of the spring element has a thickening, which is in particular formed by a bent strip of the spring element, wherein the thickening is formed in radial direction such that it is disposed at least in certain areas in form-fit manner on the outer side of the first plug part and the inner side of the retaining sleeve in a second clearance between the retaining sleeve and the first plug part in the connected state of the plug parts.

* * * * *